United States Patent [19]

Iron

[11] Patent Number: 4,608,547

[45] Date of Patent: Aug. 26, 1986

[54] CORE AND CORE LAMINATIONS FOR ELECTROMAGNETIC DEVICES

[75] Inventor: Gera Iron, Ein Hashofet, Israel

[73] Assignee: Electrical Accessories Ein Hashofet, Kibbutz Ein Hashofet, Israel

[21] Appl. No.: 734,051

[22] Filed: May 15, 1985

[30] Foreign Application Priority Data

May 22, 1984 [IL] Israel ..... 71888

[51] Int. Cl.[4] ..... H01F 3/00

[52] U.S. Cl. ..... 335/297; 336/178; 336/216

[58] Field of Search ..... 335/281, 296, 297; 336/178, 211, 212, 216

[56] References Cited

U.S. PATENT DOCUMENTS

| | | | |
|---|---|---|---|
| 2,797,395 | 6/1957 | Oglesbee et al. | 336/216 X |
| 2,977,555 | 3/1961 | Cornell et al. | 336/216 X |
| 4,282,567 | 8/1981 | Voigt | 336/178 X |

FOREIGN PATENT DOCUMENTS

| | | | |
|---|---|---|---|
| 1426419 | 2/1976 | United Kingdom | 336/178 |

*Primary Examiner*—George Harris

*Attorney, Agent, or Firm*—Natter & Natter

[57] ABSTRACT

There is provided a core lamination for electromagnetic devices. The lamination comprises an open, substantially C-shaped frame having inwardly pointing end portions facing one another across a gap, and a central limb of a substantially rectangular shape, tightly insertable with its width into the gap between the end portions. When thus inserted, the central limb defines the space enclosed by the frame two window-like openings, each of which has a height-to-width ratio of about 3:1. The shapes and relative dimensions of the open frame and the central limb are such that they are capable of interlocking and of fully tesselating a surface delimited by two parallel edges.

5 Claims, 4 Drawing Figures

CORE AND CORE LAMINATIONS FOR ELECTROMAGNETIC DEVICES

Figure 1:
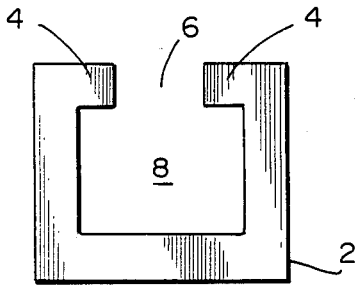

The present invention relates to a core lamination for cores used in electromagnetic devices, in particular for cores of ballasts for discharge lamps.

Such laminations, which are stamped from electrical steel strip, must meet at least three demands: Their shape must be such that the cores made from them are magnetically efficient, that is, have a favorable, uniform flux configuration, and are cheaply produced, that is, permit a scrapless strip layout. The first demand also includes a favorable length-to-width ratio of the "windows" for the coils, which has been found to be about 3:1. A further demand is ease of assembly, with no need for screws, rivets, brackets and the like to keep the parts together.

None of the prior-art cores meet all these demands. They are either well designed with regard to flux configuration and coil-window proportions, but have a strip layout that produces a certain amount of scrap, or they have a scrapless strip layout, but unfavorable window dimensions, and require fasteners or brackets.

The German patent No. DE-933781 (Schwabe), for instance, discloses a lamination with a substantially scrapless layout. However, it can be shown that, with this design, the height-to-width proportion of the coil windows can only be about 1.5:1, which is definitely unfavorable as, given the same induction, i.e., the same number of turns, a coil in such a "low" window must have far more layers than a coil in a 3:1 window. Also, the Schwabe art envisages the use of a bracket for which there are provided notches (9) that definitely complicate the stamping die.

It is one of the objects of the present invention to overcome the above difficulties and drawbacks, and to provide a two-part core lamination with an adjustable air gap, that meets all of the above-mentioned conditions in that its strip layout is totally scrapless, the design of the die set required is relatively simple and the die plate has no superfluous stress-inducing notches, and the window proportion is about 3:1.

This invention achieves by providing a core lamination for electromagnetic devices, comprising:

an open, substantially C-shaped frame having inwardly pointing end portions facing one another across a gap;

a central limb of a substantially rectangular shape, tightly insertable with its width into the gap between said end portions and, when thus inserted, defining within the space enclosed by said frame two window-like openings, each of which has a height-to-width ratio of about 3:1, wherein the shapes and relative dimensions of said open frame and said central limb are such that they are capable of interlocking and of fully tesselating a surface delimited by two parallel edges.

It will be appreciated that a window proportion of 3:1 provides room for two or more coils separated by magnetic shunts, thus enabling the design of a stray-field transformer/ballast, a design practically impossible with the Schwabe lamination.

The invention will now be described in connection with certain preferred embodiments in the following examples so that it may be more fully understood. It is not, however, intended to limit the invention to these particular embodiments. On the contrary, it is intended that all alternatives, modifications and equivalents as may be included within the scope of the invention as defined by lthe appended claims be included herein. Thus, the following examples which include preferred embodiments will serve only to illustrate the practice of this invention, it being understood that the particular formulations described are by way of example and for purposes of illustrative discussion of preferred embodiments of the present invention only and are presented in the cause of providing what is believed to be the most useful and readily understood description of formulation procedures as well as of the principles and conceptual aspects of the invention.

Figure 2:
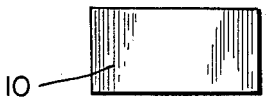
Figure 3:
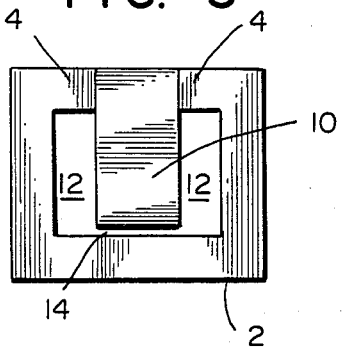
Figure 4:
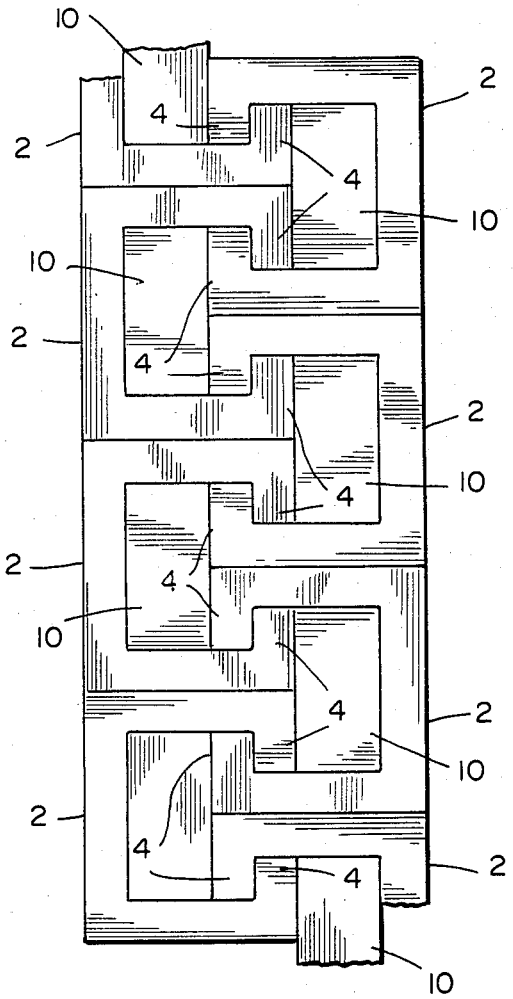

In the drawings:

FIGS. 1 and 2 show the core frame and central flux-return limb, respectively, of the lamination according to the invention, FIG. 3 illustrates a core as assembled from the laminations of FIGS. 1 and 2, and FIG. 4 shows the strip layout of the core lamination of FIGS. 1 and 2.

Referring now to the drawings, there is seen in FIG. 1 a first element of the lamination according to the invention which consists of an open, C-shaped frame 2 which has two inwardly pointing end portions 4 facing one another across a gap 6. The frame encloses a space 8.

The second element of the lamination according to the invention is a central limb 10 of a rectangular shape as shown in FIG. 2, having a width about twice the width of the limbs of the frame 2, and a length about twice its own width. Both elements are punched out from electrical steel strip, using a strip layout to be explained further below.

A view of the core assembled from the stacked elements described above is given in FIG. 3, where it can be seen that the stacked central limbs 10 are forced into the gap between the inwardly pointing end portions 4 of the frame 2, where they are retained by friction, needing no external means of fastening. It is also seen that the inserted central limb 10 now defines two window-like openings 12 which provide room for the coils of the final product, e.g., a ballast for a discharge lamp. These openings 12 have a height-to-width ratio of about 3:1, which was found to be most favorable as far as the effectiveness and ease of manufacture of the coils are concerned. Also seen in this drawing is an air gap 14 which can be adjusted by forcing the central limb 10 down against a gap filler (not shown) of a soft, non-ferromagnetic substance having the required thickness.

FIG. 4 illustrates the strip layout made possible by the design and relative dimensions of the two lamination elements 2 and 10. It is seen that the interlocking layout, in which the space 8 (FIG. 1) inside each frame 2 is completely filled by one central limb 10 and two of the end portions 4, one each of two adjacent frames 2, fully "tesselates" the strip, in other words, that this layout is "scrapless" and that there is absolutely no waste of material.

While the embodiment discussed is particularly suitable for ballasts for discharge lamps, it should be understood that the laminations according to the invention are also suitable for other devices such as, e.g., transformers.

It will be evident to those skilled in the art that the invention is not limited to the details of the foregoing illustrative embodiments and that the present invention may be embodied in other specific forms without departing from the spirit or essential attributes thereof.

The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A core lamination for electromagnetic devices, comprising:

an open, substantially C-shaped frame having inwardly pointing end portions facing one another across a gap;

a central limb of a substantially rectangular shape, tightly insertable with its width into the gap between said end portions and, when thus inserted, defining within the space enclosed by said frame two window-like openings, each of which has a height-to-width ratio of about 3:1, wherein the shapes and relative dimensions of said open frame and said central limb are such that they are capable of interlocking and of fully tesselating a surface delimited by two parallel edges.

2. The lamination as claimed in claim 1, wherein the width of said rectangular central limb is about twice the width of the limbs of said C-shaped frame.

3. The lamination as claimed in claim 1, wherein the length of said central limb is about twice its width.

4. A core for electromagnetic devices, whenever assembled from the laminations according to claim 1.

5. The core as claimed in claim 4, further comprising an adjustable air gap between the end of said central limb and the limb of said frame faced by said end.

* * * * *